US005104046A

United States Patent [19]

Sakagami

[11] Patent Number: 5,104,046

[45] Date of Patent: Apr. 14, 1992

[54] FUEL INJECTION HAVING A SINGLE SOLENOID

[75] Inventor: Eiji Sakagami, Anjo, Japan

[73] Assignee: Aisin Seiki Kabushiki Kaisha, Kariya, Japan

[21] Appl. No.: 619,960

[22] Filed: Nov. 30, 1990

[30] Foreign Application Priority Data

Nov. 30, 1989 [JP] Japan ..... 01-311599

[51] Int. Cl.[5] ..... B05B 1/30

[52] U.S. Cl. ..... 239/585; 137/898

[58] Field of Search ..... 239/585, 407-409, 239/411; 123/531, 533, 90.11; 137/898, 596.17

[56] References Cited

U.S. PATENT DOCUMENTS 4,020,803 5/1977 Thuren et al. ..... 123/90.11

4,655,255 4/1987 Rode ..... 137/596.17

*Primary Examiner*—Andres Kashnikow

*Assistant Examiner*—Lesley D. Morris

*Attorney, Agent, or Firm*—Oblon, Spivak, McClelland, Maier & Neustadt

[57] ABSTRACT

A fuel injector includes a measuring valve, a movable valve seat opened or closed by the measuring valve, a bobbin having a coil, an armature loosely fitted in one end of a through hole of the bobbin, a core inserted into the other end of the through hole, a nozzle having an injecting hole, a rod opening or closing the injecting hole and fixed to the movable valve seat, a diaphragm dividing a mixing chamber and a fuel chamber in the through hole, a fuel passage communicating between the mixing chamber and the fuel chamber, a first spring disposed between the movable valve seat and the nozzle, and a second spring disposed between the measuring valve and the armature. A measuring current supplied to the coil is smaller than an injecting current supplied to the coil, and the urging force of the first spring is larger than the urging force of the second spring.

13 Claims, 5 Drawing Sheets

FUEL INJECTION HAVING A SINGLE SOLENOID

BACKGROUND OF THE INVENTION

1. Field of the Invention

The present invention relates to a fuel injector for an internal combustion engine and more particularly to a fuel injector for a 2-cycle engine.

2. Description of the Related Art

A conventional fuel injector 100, as shown in FIG. 6, is disclosed in Japanese Patent Laid-open Print No. 62(1987)-93481, published without examination. The fuel injector 100 has two solenoids 101, 102 controlled by a control processing unit 103.

Fuel (e.g., gasoline) stored in a fuel tank 104 is pumped to the solenoid 101 by a fuel pump 105 via a fuel filter 106 at all times. The solenoid 101 controls the volume of fuel supplied to a chamber 107. Namely, fuel is measured according to the opening time of the solenoid 101.

High pressure air stored in an air tank 108 is supplied to a mixing chamber 110 including the chamber 107 via an air filter 109 at all times. The solenoid 102 controls a valve 111 which opens or closes an injecting hole 112.

The central processing unit 103 controls the solenoids 101, 102 as follows. First, the solenoid 101 supplies fuel to the chamber 107 when the solenoid 101 opens. Fuel is thus mixed with high pressure air in the mixing space 110. Next, the solenoid 102 controls the valve 111 which opens the injecting hole 112. A mixture of fuel and high pressure air is thus injected out from the fuel injector 100 via the injecting hole 112 to an engine (not shown). Therefore, the fuel is highly atomized.

Here, two solenoids 101, 102 are needed in the fuel injector. So, the fuel injector becomes large in scale or mass, and the reliability thereof is lowered.

SUMMARY OF THE INVENTION

Accordingly, it is a primary object of the present invention to sequentially measure fuel and inject high pressure air by one solenoid system in a fuel injector.

The above and other objects are achieved according to the present invention which includes means for defining a fuel chamber continuously communicating with a source of fuel, means for defining a mixing chamber and measuring valve means for selectively communicating the fuel chamber with the mixing chamber, whereby an amount of fuel to be injected is metered into the mixing chamber. An injecting valve means selectively injects metered fuel from the mixing chamber. Means are provided for opening only the measuring valve in response to a low current in a solenoid and for operating at least the injecting valve in response to a high current in the solenoid.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawing, wherein.

DETAILED DESCRIPTION OF THE PREFERRED EMBODIMENTS

Figure 1:
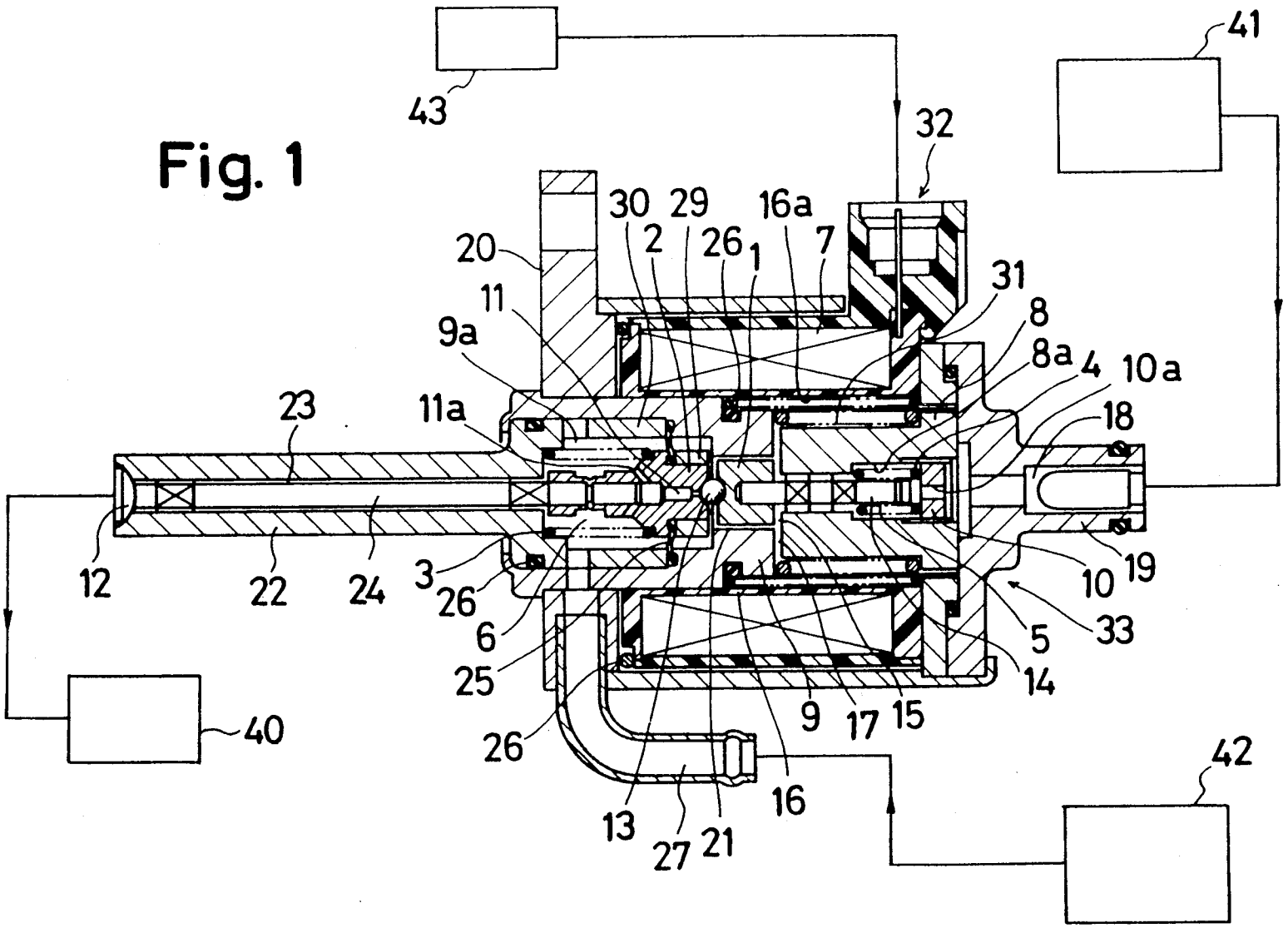
FIG. 1 is a cross-section view of a fuel injector according to one embodiment of the invention.

Referring first to FIG. 1 wherein a fuel injector is shown, a ball valve 13 is fixed to one end of a measuring valve 1, and a rod 14 is fixed to the other end thereof. The rod 14 is slidably fitted in a through hole 8*a* of an armature 8. An adjuster 10 having a through hole 10*a* is screwed into one end of through hole 8*a*, and a second spring 4 is interposed between the rod 14 and the adjuster 10 to urge the rod 14 away from the adjuster. The urging force of the second spring 4 is controlled by the adjuster 10.

A core 9 has a through hole 21 and defines a chamber 9*a*. In the chamber 9*a*, a movable valve seat 2 is supported by a diaphragm 25. An inner portion of the diaphragm 25 is held between the movable valve seat 2 and a first holder 29, and an outer portion of the diaphragm 25 is held between the core 9 and a second holder 30. Fuel passages 11, 11*a* are formed in the movable valve seat 2. One end of the fuel passage 11 is opened or closed by the ball valve 13.

In the chamber 9*a*, to the left of the diaphragm 25, is a mixing chamber 6. One end of a rod 24 is fixed to the movable valve seat 2, and the other end thereof serves for opening or closing an injecting hole 12. The injecting hole 12 is formed at one end of a nozzle 22 which has a passage 23. The injecting hole 12 is in fluid communication with the mixing chamber 6 via the passage 23. The other end of the nozzle 22 is fixed to the core 9 via a seal member 26. A first spring 3 is disposed between the movable valve seat and the nozzle 22 so as to bias the movable valve seat away from the nozzle 22 and close the injecting hole 12. The injecting hole 12 opens into a combustion chamber (not shown) of an engine 40.

A coil 7 is wound around a bobbin 16 made of resin. Both ends of the coil 7 are connected to a pair of connectors 32 (only one is shown) which are connected with a central processing unit 43. The armature 8 is loosely fitted in one end of a through hole 16*a* of the bobbin 16, and the core 9 is inserted into the other end of the through hole 16*a*. A third spring 31 is disposed between the armature 8 and the core 9 so as to bias the armature 8 away from the core 9.

A cover 19 and a casing 20 are located at opposite ends of the bobbin 16. A fuel passage 18 is formed in the cover 19. In the bobbin 16 and the cover 19, to the right of the diaphragm 25, is a fuel chamber 5 which is connected to a fuel source 41 via the through hole 10*a*. The mixing chamber 6 is connected to a high pressure air source 42 via an air passage 27. A magnetic circuit 33 is composed of the coil 7, the casing 20, the cover 19, the armature 8, the core 9 and the measuring valve 1.

When a driving current is not supplied to the coil 7, a gap 15 is formed between a right end of the measuring valve 1 and a left end of the armature 8 due to the biasing of the spring 4, and a gap 17 is formed between a right end of the core 9 and the left end of the armature 8 due to the biasing of the spring 31. Each urging force of springs 3, 4, 31 is previously set or adjusted to satisfy the above-mentioned condition. It is noted that the urging force of the first spring 3 is larger than that of the second spring 4.

Figure 5:
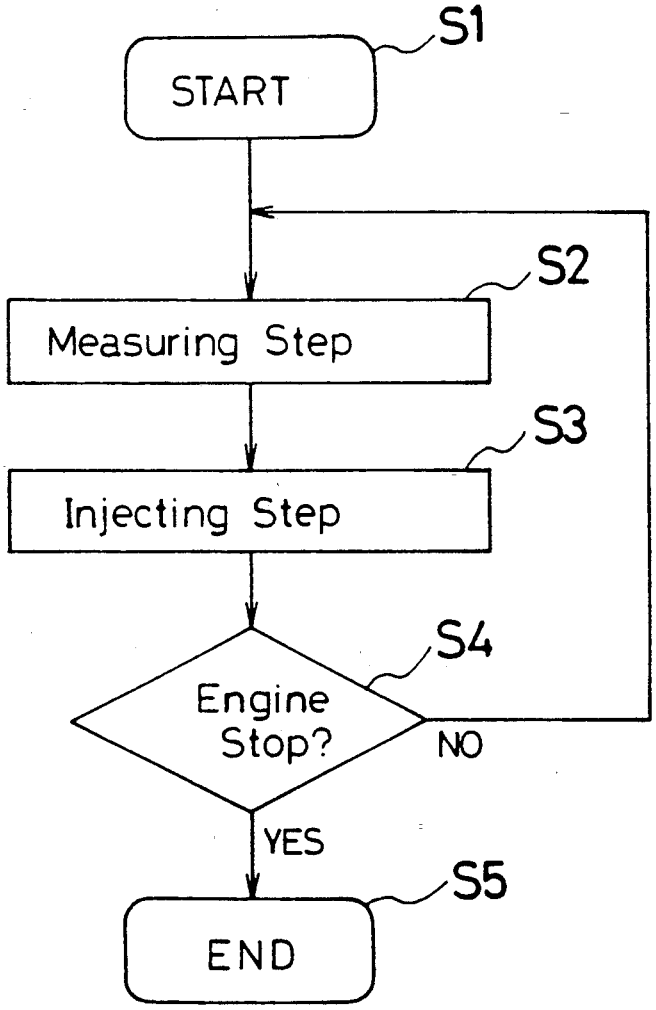
FIG. 5 is a flow-chart for control of the embodiment of FIGS. 1, 2.
Figure 6:
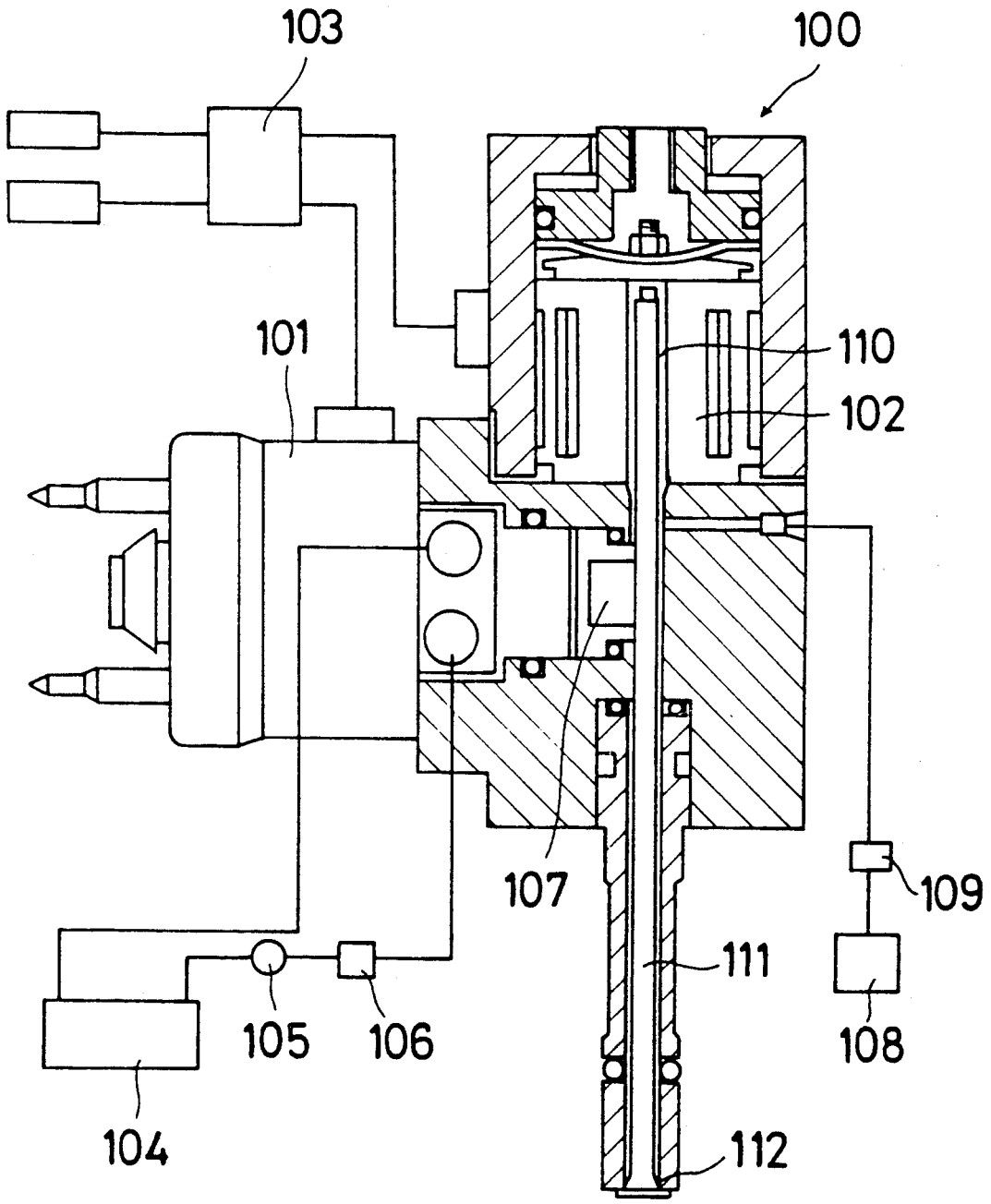
Fig. 6 (PRIOR ART)
FIG. 6 is a cross-sectional view of a conventional fuel injector.

In the above-mentioned fuel injector 10, fuel is always supplied to the fuel chamber 5, and high pressure air is always supplied to the mixing chamber 6. The fuel injector 10 is controlled by the central processing unit 43 according to the flow-chart shown in FIG. 5. Namely, the action of the central processing unit 43 according to the flow-chart is started at the step S1. At step S2, a measuring step is practiced. At step S3, an injecting step is practiced. At the step S4, it is judged whether the engine 40 is stopped. Here, if the engine 40 is stopped, the action of the central processing unit 43 is ended at step S5. If the engine 40 is determined to be operating at step S4, the central processing unit 43 repeats the step S2 and the step S3.

(1) Measuring Step

Figure 3:
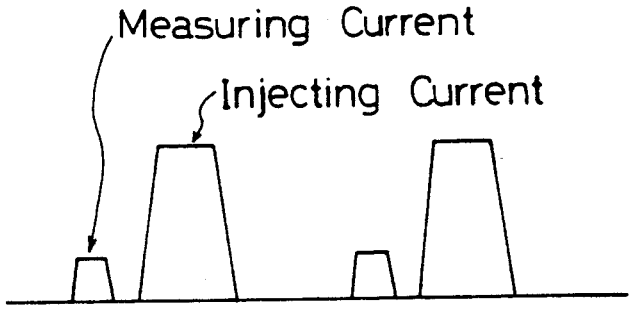
FIG. 3 is a characteristic view of current-pattern for the embodiment of FIG. 1.

A measuring current (shown in FIG. 3) is first supplied to the coil 7. The measuring current is small, so that a measuring magnetic force generated in the magnetic circuit 33 is also small. Thus, only the measuring valve 1 is moved in the rightward direction by the measuring magnetic force until the gap 15 disappears, due to its magnetic attraction to the armature 8. Here, the measuring magnetic force is smaller than the urging force of the first spring 3, and so the movable valve seat does not move to open the injecting hole 12.

Therefore, the ball valve 13 opens one end of the fuel passage 11. So, while the measuring current is supplied to the coil 7, fuel in the fuel chamber 5 flows into the mixing chamber 6 via the fuel passages 11, 11*a*. Consequently, the amount of fuel supplied to the mixing chamber 6 (namely, fuel to be injected from the fuel injector 10) depends on the supplying time of measuring current. When the measuring current is interrupted, the measuring valve 1 is moved in the leftward direction by the urging force of the second spring 4.

(2) Injecting Step

An injecting current (shown in FIG. 3) is supplied to the coil 7. The polarity of the measuring current is as same as the polarity of the injecting current. The injecting current is larger than the measuring current, so that an injecting magnetic force generated in the magnetic circuit 33 is larger than the measuring magnetic force. So, the measuring valve 1 is again moved in the rightward direction by the injecting magnetic force until the gap 15 quickly disappears. Immediately after that, the armature 8 is moved in the leftward direction by the injecting magnetic force until the gap 17 disappears. So, one end of the fuel passage 11 is closed by the ball valve 13. The reason is that the injecting magnetic force is larger than the urging force of the first spring 3.

Therefore the movable valve seat 2 is moved in the leftward direction by the armature 8 via the rod 14 and the measuring valve against the urging force of the first spring 3. So, the injecting hole 12 is opened by rod 24 fixed to the movable valve seat 2.

Consequently, a mixture of fuel and high pressure air is injected and atomized from the injecting hole 12 to the combustion chamber of the engine.

Here, the quantity of the fuel injected is total of the quantity of fuel measured at the measuring step and the quantity of fuel delivered when the ball valve 13 opens one end of the fuel passage 11 in the injecting step. This quantity of the fuel delivered in the injecting step is always constant.

Figure 2:
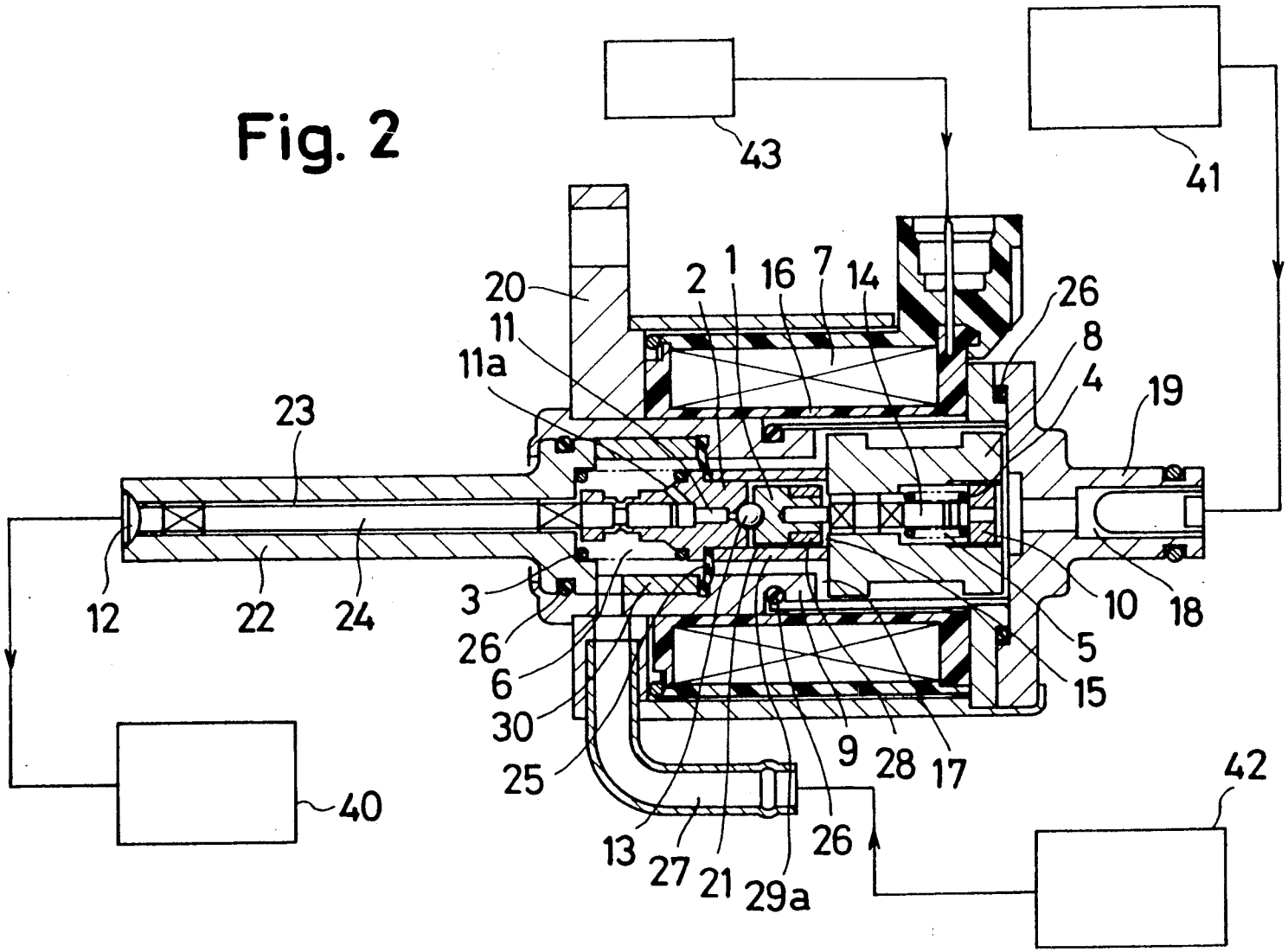
FIG. 2 is a cross-sectional view of a fuel injector according to another embodiment of the invention.

Next, referring to FIG. 2, there is shown a fuel injector of a second embodiment according to the present invention. Only the construction different from the first embodiment will be described hereinafter.

A ring-shaped permanent magnet 28 is located around the right end of the measuring valve 1. The outside diameter of the magnet 28 is as same as that of the measuring valve 1 at the left end. A right end of a first holder 29*a* made of nonmagnetic material is secured to the armature 8. It is noted that a third spring which corresponds to the third spring 31 of the first embodiment is not employed.

(1) Measuring Step

Figure 4:
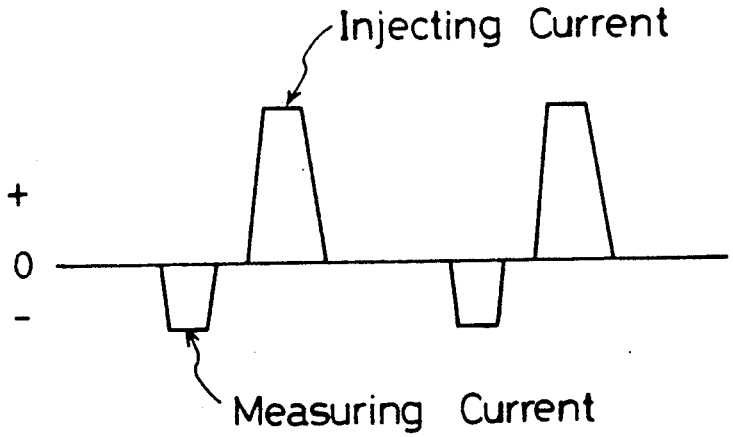
FIG. 4 is a characteristic view of current-pattern for the embodiment of FIG. 2.

There is no difference from the first embodiment except for the polarity of a measuring current (shown in FIG. 4). The negative polarity of the measuring current attracts the magnet 28 to the armature 8, causing it to move to the right and open the ball valve.

(2) Injecting Step

There is no difference from the first embodiment except as follows.

An injecting current (shown in FIG. 4) is supplied to the coil 7. The injecting current is larger than the measuring current, whose polarity is contrary thereto. The polarity of the magnet 28 repels against a polarity generated in the magnetic circuit 33. Thus, the measuring valve 1 does not initially move to the right and only the armature 8 is moved in the leftward direction by the injecting magnetic force until the gap 17 disappears. Thus, the movable valve seat is moved to the left by the first holder 29*a*. Moreover, one end of the fuel passage 11 remains closed by the ball valve 13 since the end of the measuring step, and the quantity of the injected fuel is only that quantity measured at the measuring step.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A fuel injector for sequentially metering and injecting a fuel, comprising:

means for defining a fuel chamber continuously communicating with a source of fuel;

means for defining a mixing chamber;

measuring valve means for selectively communicating said fuel chamber with said mixing chamber, whereby an amount of fuel to be injected is metered into said mixing chamber;

injecting valve means for selectively injecting metered fuel from said mixing chamber;

a solenoid; and means for opening only said measuring valve means in response to a low current in said solenoid and for opening at least said injecting valve means in response to a high current in said solenoid.

2. The fuel injector of claim 1, wherein said means for defining a fuel chamber includes a diaphragm separating said fuel chamber from said mixing chamber.

3. The fuel injector of claim 2, wherein said means for defining a mixing chamber comprises a movable valve seat supporting one end of said diaphragm.

4. The fuel injector of claim 3, wherein said injecting valve means is mounted for movement with said movable valve seat.

5. The fuel injector of claim 3, wherein said measuring valve means comprises at least one fuel passage in said movable valve seat and connecting said fuel chamber with said mixing chamber, and a measuring valve element positionable for closing said fuel passage.

6. The fuel injector of claim 1, wherein said opening means comprises first spring means for normally closing said injecting valve means; and second spring means for normally closing said measuring valve means; and an armature forming a part of a magnetic circuit including said solenoid and being operatively connected to said measuring valve means and said injecting valve means, wherein a biasing force of said first spring means is greater than that of said second spring means, whereby a magnetic force sufficient for overcoming said biasing force of said second spring means may be insufficient for overcoming the biasing force of said first spring means.

7. The fuel injector of claim 5, wherein said opening means comprises first spring means for normally closing said injecting valve means;

second spring means for normally closing said measuring valve means; and an armature forming a part of a magnetic circuit including said solenoid and being operatively connected to said measuring valve means and said injecting valve means, wherein a biasing force of said first spring means is greater than that of said second spring means, whereby a magnetic force sufficient for overcoming said biasing force of said second spring means may be insufficient for overcoming the biasing force of said first spring means.

8. The fuel injector of claim 7, wherein said armature magnetically attracts said metering valve in response to the low current for opening said measuring valve means.

9. The fuel injector of claim 8, wherein said armature includes means for moving said metering valve to press on said movable valve seat and open said injecting valve means in response to the high current.

10. The fuel injector of claim 9, including third spring means for biasing said armature away from said movable valve seat.

11. The fuel injector of claim 7, including means for providing the low current and the high current with a polarity opposite to that of the low current.

12. The fuel injector of claim 11, wherein said opening means further comprises a permanent magnet mounted to said metering valve, wherein said armature magnetically repels said magnet and said metering valve in response to the high current.

13. The fuel injector of claim 1, including means for supplying high pressure air to said mixing chamber.

* * * * *

UNITED STATES PATENT AND TRADEMARK OFFICE

CERTIFICATE OF CORRECTION

PATENT NO. : 5,104,046

DATED : April 14, 1992

INVENTOR(S) : Eiji Sakagami et al.

It is certified that error appears in the above-identified patent and that said Letters Patent is hereby corrected as shown below:

TITLE PAGE

Item [75], inventorship should read -- Eiji Sakagami, Motonobu Akagi, both of Anjo; Masaharu Hayashi, Toyota, all of Japan--.

Signed and Sealed this

Twenty-ninth Day of June, 1993

*Attest:*

Michael K. Kirk

MICHAEL K. KIRK

*Attesting Officer*

*Acting Commissioner of Patents and Trademarks*